United States Patent [19]

Kruse et al.

[11] Patent Number: 4,839,078

[45] **Date of Patent: * Jun. 13, 1989**

[54] DETERGENT TABLETS OF UNIFORM COMPOSITION FOR DISHWASHING MACHINES

[75] Inventors: Hans Kruse, Korschenbroich; Jochen Jacobs, Wuppertal; Theodor Altenschoepfer, Duesseldorf; Peter Jeschke, Neuss, all of Fed. Rep. of Germany

[73] Assignee: Henkel Kommanditgesellschaft auf Aktien, Duesseldorf, Fed. Rep. of Germany

[ * ] Notice: The portion of the term of this patent subsequent to May 9, 2006 has been disclaimed.

[21] Appl. No.: 931,776

[22] Filed: Nov. 17, 1986

[30] Foreign Application Priority Data

Nov. 21, 1985 [DE] Fed. Rep. of Germany ..... 3541145

[51] Int. Cl.[4] ..... C11D 7/18

[52] U.S. Cl. ..... 252/99; 252/135; 252/174; 134/25.2

[58] Field of Search ..... 252/174, 174.13, 135, 252/99, 174; 23/313; 134/25.2, 29, 99

[56] References Cited

U.S. PATENT DOCUMENTS

| | | | |
|---|---|---|---|
| 2,412,819 | 12/1946 | MacMahon | 252/138 |
| 3,247,123 | 4/1986 | Schrager et al. | 252/135 |
| 3,390,092 | 6/1968 | Keast et al. | 252/99 |
| 4,219,435 | 8/1980 | Baird et al. | 252/135 |
| 4,219,436 | 4/1980 | Gromer et al. | 252/135 |
| 4,518,516 | 5/1985 | Goddard et al. | 252/174 |

FOREIGN PATENT DOCUMENTS 3315950 11/1984 Fed. Rep. of Germany .

*Primary Examiner*—Paul Lieberman
*Assistant Examiner*—John F. McNally
*Attorney, Agent, or Firm*—Ernest G. Szoke; Wayne C. Jaeschke; Real J. Grandmaison

[57] ABSTRACT

Tablets having a broad solubility profile containing a mixture of sodium metasilicate nonahydrate and anhydrous sodium metasilicate with a grain size of from 0.2 to 0.8 mm in a ratio by weight of from 1:0.75 to 1:1.2, anhydrous pentasodium triphosphate having a grain diameter of 0.2 to 0.3 mm, and 0.5 to 5% by weight of an active chlorine donor. The ratio by weight of pentasodium triphosphate to metasilicates is about 1:1 to 1:1.7, based on anhydrous substances. The tablets are used in automatic dishwashing machines where they are introduced into a free zone of the machine before the start of the prerinse cycle, at least 10% of the tablets being dissolved by inflowing cold water and at least another 70% being available in the main-wash cycle.

18 Claims, No Drawings

DETERGENT TABLETS OF UNIFORM COMPOSITION FOR DISHWASHING MACHINES

BACKGROUND OF THE INVENTION

Field of the Invention

This invention relates to detergent tablets having a uniform composition and a broad solubility profile for use in dishwashing machines wherein part of the tablets dissolves during the prerinse cycle, and the major portion of the tablets dissolves during the mainwash cycle.

Dishwashing in dishwashing machines generally comprises a prerinse cycle, a main-wash cycle, one or more intermediate rinse cycles, a clear-rinse cycle and a drying cycle. This applies both to domestic and to institutional dishwashing.

Heretofore, it has been standard practice in domestic dishwashing machines, hereinafter referred to as DDWM, to store the detergent in a dispensing compartment which is generally situated in the door of the machine and which opens automatically at the beginning of the main-wash cycle. The previous prerinse cycle is completed solely with cold tap water flowing into the machine.

In institutional dishwashing machines, hereinafter referred to as IDWM, the preliminary clearing zone corresponds in principle to the prerinse cycle of a DDWM. In machine dishwashing in large kitchens the detergent fed into the main-wash zone is actually used by overflow in the so-called preliminary clearing zone for the supportive removal of adhering food remains. Although there are also IDWM in which the preliminary clearing zone is supplied solely with fresh water, a preliminary clearing zone supplied with detergent solution is more effective than a preliminary clearing zone supplied solely with fresh water.

The object of the present invention is to apply the action principle of the preliminary clearing zone of a IDWM to a DDWM. The addition of detergents to the actual prerinse cycle was regarded as one possibility. In tests carried out with standard DDWM detergents, the effect of this was that, in addition to the usual dispensing of the detergent through the dispensing compartment in the door, more of the detergent had to be introduced into the machine itself. However, it is a well-known problem that flow-deficient regions exist both at the bottom of the machine and in the liquor sump of the machine. As a result, the product can never be adequately dissolved and, on completion of the prerinse cycle, has to be pumped off virtually unused.

Scattering detergent into the cutlery basket via the cutlery placed therein is not advisable because irreversible damage can be caused to silver and fine steel.

It has now surprisingly been found that the disadvantages mentioned above do not arise where the detergent tablets according to the invention are used. The addition of one or more tablets may be effected for example, in an empty part of the cutlery basket or even elsewhere in the machine.

DISCUSSION OF RELATED ART

The use of tablet-form detergents is described in the patent literature. For example, U.S. Pat. No. 3,390,092 describes tablets for dishwashing machines which may be obtained by tabletting a powder-form mixture of sodium silicate having a ratio of $Na_2O$ to $SiO_2$ of from 1:3.25 to 2:1 and a water content of from 0 to 20%, polymeric alkali metal phosphates, active chlorine compounds, low-foaming nonionic surfactants compatible with the active chlorine compounds, fillers, such as alkali metal carbonates, chlorides or sulfates, white paraffin oil and tablet binders, and which are said to be storable and transportable.

U.S. Pat. No. 4,219,436 describes tablets which essentially contain the same constituents but which are said to show that particularly high alkalinity may be achieved inter alia by the addition of alkali metal hydroxide. However, high alkalinity is unsuitable for domestic use of the detergents because, unless the detergents are properly handled, they can lead to skin irritation and, in addition, can damage decorative finishes.

According to German Patent Application No. 33 15 950, it is particularly advantageous, so far as the required mechanical strength of detergent tablets and their high dissolving rate are concerned, not merely to tablet the mixtures of the constituents, but instead initially to prepare a co-granulate from the alkaline-reacting constituents and then to tablet the co-granulate thus prepared under high pressure after the addition of further substances and tabletting aids.

In commercial DDWM, all the detergent tablets which have been introduced into the dispensing compartment also provided for the addition of powder-form or granular detergents which is only designed to open automatically on completion of the prerinse cycle using cold tapwater. After about 5 to 7 minutes, by which time they have been completely flushed out from the dispenser into the dishwashing liquor by the water, the tablets develop their full activity with increasing water temperature during the 20 to 30 minute long mainwash cycle. When the tablets were introduced, for example through the cutlery basket, they entered the prerinse cycle of the machine, but caused increased damage to decorative finishes on account of excessive alkalinity and/or dissolved too quickly and/or disintegrated too quickly and sank without dissolving into the liquor sump of the machine. Accordingly, the quantities of detergent available for the main-wash cycle were no longer adequate.

DESCRIPTION OF THE INVENTION

Accordingly, an object of the present invention is to provide a detergent tablet having a broad solubility profile wherein at least 10% by weight of the tablet is dissolved in only the prerinse cycle of a DDWM by the cold tapwater flowing in, producing a pH value of at least 10.0 in the wash liquor, and wherein at least 65% by weight and preferably at least 70% by weight of the tablet is available for the main-wash cycle by virtue of its good solubility in warm water.

Other than in the operating examples, or where otherwise indicated, all numbers expressing quantities of ingredients or reaction conditions used herein are to be understood as modified in all instances by the term "about."

In the context of the invention, solubility profile is understood to be the ratio of parts by weight of the tablet dissolved under the conditions of the prerinse cycle of a standard DDWM to the tablet as a whole.

According to the invention, this object is achieved by detergent tablets having a uniform composition and a broad solubility profile for dishwashing machines, containing standard alkaline-reacting components, more especially from the group consisting of alkali metal metasilicates and penta-alkali metal triphosphates, active chlorine compounds and tabletting aids, characterized in that the alkali metal metasilicates consist of a mixture of sodium metasilicate nonahydrate and anhydrous sodium metasilicate while the penta-alkali metal triphosphate consists of anhydrous penta-sodium triphosphate, the ratio by weight of anhydrous sodium metasilicate to the sodium metasilicate nonahydrate being from 1:0.3 to 1:1.5.

The solubility profile of the tablet of this invention may be varied within broad limits by varying the ratio of anhydrous sodium metasilicate to the nonahydrate. The ratio by weight of anhydrous sodium metasilicate to the sodium metasilicate nonahydrate is preferably from 1:0.75 to 1:1.2.

To obtain good dishwashing results, it is essential to adhere to a balanced prototype formulation in regard to the alkali metal metasilicate and the penta-alkali metal triphosphate contents. The quantities of anhydrous penta-sodium triphosphate to anhydrous sodium metasilicate should be in a ratio of from 2:1 to 1:2 and preferably in a ratio of from 1:1 to 1:1.7.

Active chlorine donors are also standard constituents of DDWM detergents. Finally, tabletting aids may be added to the tablets in variable quantities.

Whereas the quality of the sodium metasilicate nonahydrate is largely unproblematical, the tabletting properties of raw-material mixtures containing anhydrous sodium metasilicate are determined by its grain size distribution, the process used for its production, its ratio by weight to the nonahydrate present and by the average grain size of the pentasodium triphosphate. With a grain fraction of a substantially anhydrous sodium metasilicate, for example made from a sintering or fusion process, of smaller than 0.8 mm, favorable tabletting properties of the raw-material mixture may be obtained with only small additions, if any, of nonahydrate used for adjusting the solubility profile. Where dust (smaller than 0.2 mm) or unsieved material containing from 20 to 100% grains coarser than 0.8 mm is used, the nonahydrate should be used in at least 1.2 times the quantity, based on the anhydrous metasilicate, to obtain comparable tabletting properties. Accordingly, the grain size distribution of the anhydrous sodium metasilicate may be between about 0.01 to 2.0 mm, and preferably from 0.2 to 0.8 mm.

Where dust-form pentasodium triphosphate having an average grain diameter of smaller than 0.1 mm is used, the tabletting properties deteriorate. Accordingly, it is preferred to use a triphosphate having an average grain diameter of from 0.2 to 0.3 mm.

The use of hydrothermally produced metasilicate having a residual water content of about 2% results in raw-material mixtures having favorable tabletting properties. However, in contrast to the tablets obtained with substantially anhydrous metasilicate, the tablets prepared from these mixtures are generally not stable in storage. The surface of the tablets is rough, and relatively large tablets tend to develop cracks. Accordingly, it is preferred not to use this metasilicate with its residual moisture content.

Alkali metal metasilicate in anhydrous form and as the nonahydrate, and also the preferably anhydrous pentaalkali metal triphosphate are preferably used in the form of their sodium salts. They are present in the mixture to be tabletted in a total quantity of from 88 to 98% by weight and preferably in a total quantity of from 95 to 97% by weight.

Trichloroisocyanuric acid is preferably used as the active chlorine donor, although other known solid compounds, such as for example sodium dichloroisocyanurate, its dihydrate and potassium dichloroisocyanurate, may also be used in standard commercial form without adversely affecting the tabletting properties. They are used in quantities of from 0.5 to 5.0% by weight and preferably in quantities of from 1.0 to 2.5% by weight, based on the active chlorine content and the tabletting mixture as a whole.

A mixture of from 0.5 to 2.0% by weight and preferably 1.0% by weight, based on the tabletting mixture as a whole, of calcium hydrogen phosphate dihydrate, to reduce disintegration, and from 1.0 to 5.0% by weight and preferably from 2.0 to 3.0% by weight, based on the tabletting mixture as a whole, of anhydrous sodium acetate, to reduce adhesion to equipment, may be added as tabletting aids. The quantities in which these tabletting aids, which have no effect on detergency, are used may be increased beyond the ranges mentioned to enable modified formulations to be optimally tabletted. In addition, the sodium acetate content influences the solubility of the tablet. Larger quantities of sodium acetate lead in particular to improved cold-water solubility in the prerinse cycle. Although other standard tabletting aids, such as for example lubricants to improve the tabletting properties, for example stearates, talcum, glycerides, etc., and other auxiliaries may also be used in principle, they are undesirable in terms of application and, in addition, add to the cost of formulation and merely represent inert fillers. There is no need to use these otherwise standard auxiliaries in the production of tablets in accordance with the invention.

Standard chlorine-stable dyes and perfumes may also be added to the tabletting mixtures. For aesthetic reasons, the tablets may also be produced in colored layers for otherwise the same composition.

Tabletting of the mixture of the fine-grained anhydrous metasilicates, the corresponding nonahydrates, the triphosphates, active chlorine donors and tabletting aids, may be carried out with cavity lubrication using standard lubricants. Depending on the construction of the tabletting machine, the lubricant is applied directly through bores in the cavity, by spraying the bottom force or through lubricantimpregnated felt rings on the bottom forces. However, the raw-material mixtures according to the invention with their particularly favorable tabletting properties may not require lubrication.

In order to avoid problems caused by sticking to the forces, it is advisable to coat the forces with plastics. Plexiglas or Vulkolan coatings have proved to be particulrly favorable in this regard. However, favorable results have also been obtained with other standard materials.

The tabletting conditions are optimized to obtain the desired solubility profile coupled with adequate tablet hardness. The bending strength of the tablets may serve as a measure of their hardness (method: cf. Ritschel, "Die Tablette", Ed. Cantor, 1966, page 313). Tablets having a bending strength of greater than 12 kp and preferably greater than 15 kp are sufficiently stable under simulated transport conditions.

Corresponding tablet hardnesses are obtained using tabletting pressures of from 500 to 5000 kp/cm$^2$ and preferably from 1000 to 1500 kp/cm$^2$. Higher tabletting pressures reduce the dissolving rate of the tablets. With different compositions, solubility differences may be redressed within limits through the choice of the tabletting pressure.

The specific gravity of the tablets varies from 1.2 to 2 g/cm$^3$ and preferably from 1.4 to 1.7 g/cm$^3$. The compression applied during tabletting produced changes in the specific volume which fell from 0.8–1.8 cm$^3$/g and preferably from 1.0–1.4 cm$^3$/g, to 0.5–0.8 cm$^3$/g and preferably to 0.6–0.7 cm$^3$/g.

The shape of the tablet can also affect its dissolving rate through the outer surface exposed to the water. For reasons of stability, tablets having a diameter-to-height ratio of from 0.6 to 1.5:1 are preferably produced.

The quantities of the mixture to be tabletted for the individual tablets may be varied as required within technically appropriate limits. 1, 2 or more tablets are used per dishwashing machine load to provide the cleaning process as a whole with the necessary active substance content of detergent. Tablets weighing from 20 to 30 g are preferred, in which case two tablets have to be used. Larger tablets are generally more prone to break and, in addition, can only be formed at relatively low speeds, thus reducing output. With smaller tablets, the advantage over granulated or powder-form detergents in terms of handling would be reduced.

The described compositions may be tabletted in known manner using standard commercial eccentric presses or rotary presses.

Since there are not yet any suitable dispensers for this method of using dishwashing detergents in standard commercial dishwashing machines, the tablets may be introduced after opening the machines and before the start of the prerinse cycle into a zone which exposes the tablets to the dissolving power of the stream of tapwater, preferably into the cutlery basket of a domestic dishwashing machine, and the automatically controlled dishwashing process subsequently started.

Accordingly, the present invention also relates to the use of the detergent tablets for dishwashing in automatic domestic dishwashing machines, characterized in that the tablets are introduced after opening the machines into a zone which expose the tablets to the dissolving power of the stream of cold tapwater, for example by placement in the cutlery basket, before the start of the prerinse cycle and the automatically controlled dishwashing process is subsequently started.

Even with difficult soil, such as for example burnton milk or baked-on porridge oats, dishes washed in this way are cleaner than conventionally washed dishes.

EXAMPLES

To enable the various formulations to be better compared, tablets of the same diameter and containing the same quantities of sodium triphosphate, tricholoroisocyanuric acid and anhydrous sodium metasilicate having a weight of about 20 g to 27 g were prepared. The different weights are attributable to the varying content of water of crystallization and tabletting aids. With certain formulations, the tablet format was also varied.

Example 1

28.8% by weight anhydrous sodium metasilicate, unsieved
33.6% by weight sodium metasilicate nonahydrate
33.6% by weight anhydrous sodium triphosphate
1.0% by weight trichloroisocyanuric acid
3.0% by weight anhydrous sodium acetate
25 mm Tablet diameter
20 g tablet weight The mixture was tabletted in a Fette "Exacta 31" eccentric press in which the equipment had been coated with Vulkolan. Compression to a density of 1.58 g/cm$^3$ produced tablets having a bending strength of greater than 15 kp, of which 25% by weight dissolved in the prerinse cycle and the remainder in the main-wash cycle.

Example 2

33.7% by weight anhydrous sodium metasilicate (smaller than 0.8 mm)
26.3% by weight sodium metasilicate nonahydrate
35.0% by weight anhydrous sodium triphosphate
1.0% by weight trichloroisocyanuric acid
1.0% by weight calcium hydrogen phosphate dihydrate
3.0% by weight anhydrous sodium acetate
35 mm tablet diameter
25 g tablet weight The mixture was tabletted in a Fette "Exacta 31" eccentric press in which the equipment has been coated with Vulkolan. To produce tablets weighing 25 grams, the cavity had to be filled to a height of 30.8 mm for a diameter of 35 mm, corresponding to a specific volume of 1.18 cm$^3$/g. To produce the tablet, the top force had to penetrate to a depth of 14.5 mm, corresponding to a tablet height of 16.3 mm or to a specific volume of 0.62 cm$^3$/g. The compression ratio was thus 1:1.9. However, the actual tablet height after production was 17.7 mm. This is explained by the fact that, in general, the tablets can be expected to "grow", or swell slightly after removal of the tabletting pressure.

The specific volume of the tablet obtained was thus 0.68 cm$^3$/g (density=1.47 g/cm$^3$), corresponding to a compression ratio of 1:1.74. The pressure required for tabletting was 1300 kp/cm$^2$. The tablets obtained had a bending strength of greater than 15 kp, 14% by weight dissolving in the prerinse cycle and the remainder in the main-wash cycle.

After storage for 8 months at room temperature in a sealed container, no cracks, in the tablet or any surface efflorescense were observed.

Example 3

The omission of tabletting aids and the corresponding variation of the metasilicate contents with anhydrous product to 30.7% by weight and nonahydrate to 33.3% by weight for otherwise the same procedure as in Example 2 produced a dissolution of 40% by weight of the tablet in the prerinse cycle and complete dissolution of the remainder in the main wash cycle. In the production of these tablets, however, slight sticking of the tabletting mixture occurred in the cavity.

The Examples may be varied as required within the scope of the invention. The preceding selected Examples should not be regarded as conclusive.

Example 4

33.0% by weight sodium metasilicate containing 2% residual moisture
28.0% by weight sodium metasilicate nonahydrate
35.0% by weight anhydrous sodium triphosphate
1.0% by weight trichloroisocyanuric acid
2.0% by weight anhydrous sodium acetate
1.0% by weight calcium hydrogen phosphate dihydrate
25 mm tablet diameter
20.3 g tablet weight The constituents were mixed in a Lodige mixer.

The mixture was tabletted in a Fette "Exacta" eccentric press in which the equipment had been coated with Vulkolan. Compression to a density of 1.56 g/cm$^3$ produced tablets having a bending strength (Ritschel, "Die Tablette" page 313) of 13.5 kp wherein about 20% were dissolved by the inflow of tapwater in the prerinse cycle of a DDWM and the remainder in the 40° C. main-wash cycle.

The tabletting equipment did not have to be lubricated with paraffin oil. The omission of calcium hydrogen phosphate dihydrate produced a dissolution of 25% by weight of the tablet in the prerinse cycle and a total tablet dissolution of 97% by weight. After storage, however, the tablets showed signs of surface efflorescense due to their residual moisture content.

Example 5

The composition of the mixture, the weight and the diameter of the tablets were the same as in Example 4. In contrast to Example 4, however, the mixture was compressed to a density of 1.63 g/cm$^3$. The bending strength of the tablets produced was greater than 15 kp. For complete dissolution in the 40° C. main-wash cycle, 12% of the tablet had dissolved after the prerinse cycle. Despite excellent production and performance properties, the surface of the tablets again showed signs of efflorescense after storage.

Example 6

Composition as in Example 4.

40 mm tablet diameter 50 g tablet weight

The mixture was tabletted in a Fette "Exacta 31" eccentric press in which the equipment had been coated with Vulkolan. Compression to a density of 1.53 g/cm$^3$ produced tablets having a bending strength of greater than 15 kp, wherein 14% by weight dissolved in the prerinse cycle and 97% by weight dissolved after the main-wash cycle.

After storage for 8 months at room temperature in sealed containers, the tablets showed unwanted cracks and surface efflorescence.

Example 7

33.0% by weight anhydrous sodium metasilicate (smaller than 0.8 mm)

28.0% by weight sodium metasilicate nonahydrate 35.0% by weight anhydrous sodium triphosphate 3.0% by weight anhydrous sodium acetate 1.0% by weight calcium hydrogen phosphate dihydrate 25 mm tablet diameter 6.7 g tablet weight The mixture was tabletted in a Fette "Perfecta 2" rotary press wherein the equipment had been coated with Plexiglas. The mixture was prepared continuously via belt weighers in a Gericke "GAC 350" mixer. The cavity was filled by a Fette "Fil-o-Matic". The material was prevented from caking by lubrication with paraffin oil using impregnated felt rings on the bottom forces. Compression to a density of 1.52 produced tablets having a bending strength of greater than 15 kp.

We claim:

1. A detergent tablet having a uniform composition and a broad solubility profile for use in automatic dishwashing machines, said tablet consisting of alkaline-reacting components selected from the group consisting of alkali metal metasilicate, penta-alkali metal triphosphate, an active chlorine compound, and tabletting aids, wherein said alkali metal metasilicate consists of a mixture of anhydrous sodium metasilicate and sodium metasilicate nonahydrate and said penta-alkali metal triphosphate consists of anhydrous pentasodium triphosphate, and the ratio by weight of said anhydrous sodium metasilicate to said sodium metasilicate nonahydrate is from about 1:0.3 to 1:1.5, and the ratio by weight of said anhydrous pentasodium triphosphate to said anhydrous sodium metasilicate is from about 2:1 to 1:2, wherein at least about 10% by weight of said tablet is dissolved in the pre-rinse cycle of said dishwashing machines by the cold tap water flowing in producing a pH value of at least about 10 in the wash liquor, and wherein at least about 65% by weight of said tablet is available for the main wash cycle of said dishwashing machines by virtue of its solubility in warm water.

2. A detergent tablet in accordance with claim 1 wherein the ratio by weight of said anhydrous sodium metasilicate to said sodium metasilicate nonahydrate is from about 1:0.75 to 1:1.2.

3. A detergent tablet in accordance with claim 1 wherein said anhydrous penta-sodium triphosphate has an average grain diameter of from about 0.2 to about 0.3 mm.

4. A detergent tablet in accordance with claim 1 wherein said anhydrous sodium metasilicate has a grain size distribution of between about 0.01 to about 2.0 mm.

5. A detergent tablet in accordance with claim 1 wherein said mixture of anhydrous sodium metasilicate, sodium metasilicate nonahydrate and said anhydrous pentasodium triphosphate is present in an amount of from about 88 to about 98% by weight, based on the weight of said tablet.

6. A detergent tablet in accordance with claim 1 wherein said active chlorine compound is present in an amount of from about 0.5 to about 5.0% by weight, based on the weight of said tablet.

7. A detergent tablet in accordance with claim 6 wherein said active chlorine compound comprises trichloroisocyanuric acid.

8. A detergent tablet in accordance with claim 1 wherein said tabletting aids are present in an amount of from about 0.5 to about 7.0% by weight, based on the weight of said tablet.

9. A detergent tablet having a uniform composition and a broad solubility profile for use in automatic dishwashing machines, said tablet consisting of from about 88 to about 98% by weight of a mixture of anhydrous sodium metasilicate, sodium metasilicate nonahydrate and anhydrous penta-sodium triphosphate; from about 0.5 to about 5.0% by weight of an active chlorine compound; and from about 0.5 to about 7.0% by weight of tabletting aids; all weights being based on the weight of said tablet, and the ratio by weight of said anhydrous sodium metasilicate to said sodium metasilicate nonahydrate is from about 1:0.3 to 1:1.5, and the ratio by weight of said anhydrous pentasodium triphosphate to said anhydrous sodium metasilicate is from about 2:1 to 1:2, wherein at least about 10% by weight of said tablet is dissolved in the pre-rinse cycle of said dishwashing machines by the cold tap water flowing in producing a pH value of at least about 10 in the wash liquor, and wherein at least about 65% by weight of said tablet is available for the main wash cycle of said dishwashing machines by virtue of its solubility in warm water.

10. A dishwashing process comprising introducing a detergent tablet into a zone of an automatic dishwashing machine which exposes said tablet to the dissolving power of the inflowing stream of cold water during the pre-rinse cycle of said machine, said detergent tablet having a uniform composition and a broad solubility profile for use in automatic dishwashing machines, said tablet consisting of alkaline-reacting components selected from the group consisting of alkali metal metasilicate, penta-alkali metal triphosphate, an active chlorine compound, and tabletting aids, wherein said alkali metal metasilicate consists of a mixture of anhydrous sodium metasilicate and sodium metasilicate nonahydrate and said penta-alkali metal triphosphate consists of anhydrous penta-sodium triphosphate, and the ratio by weight of said anhydrous sodium metasilicate to said sodium metasilicate nonahydrate is from about 1:0.3 to 1:1.5, and the ratio by weight of said anhydrous penta-sodium triphosphate to said anhydrous sodium metasilicate is from about 2:1 to 1:2, and starting said machine, whereby at least about 10% by weight of said tablet is dissolved in the pre-rinse cycle of said dishwashing machines by the cold water flowing in producing a pH value of at least about 10 in the wash liquor, and wherein at least about 65% by weight of said tablet is available for the main wash cycle of said dishwashing machines by virtue of its solubility in warm water.

11. A dishwashing process in accordance with claim 10 wherein the ratio by weight of said anhydrous sodium metasilicate to said sodium metasilicate nonahydrate is from about 1:0.75 to 1:1.2.

12. A dishwashing process in accordance with claim 10 wherein said anhydrous penta-sodium triphosphate has an average grain diameter of from about 0.2 to about 0.3 mm.

13. A dishwashing process in accordance with claim 10 wherein said anhydrous sodium metasilicate has a grain size distribution of between about 0.01 to about 2.0 mm.

14. A dishwashing process in accordance with claim 10 wherein said mixture of anhydrous sodium metasilicate, sodium metasilicate nonahydrate and said anhydrous penta-sodium triphosphate is present in an amount of from about 88 to about 98% by weight, based on the weight of said tablet.

15. A dishwashing process in accordance with claim 10 wherein said active chlorine compound is present in an amount of from about 0.5 to about 5.0% by weight, based on the weight of said tablet.

16. A dishwashing process in accordance with claim 15 wherein said active chlorine compound comprises trichloroisocyanuric acid.

17. A dishwashing process in accordance with claim 10 wherein said tabletting aids are present in an amount of from about 0.5 to about 7.0% by weight, based on the weight of said tablet.

18. A dishwashing process in accordance with claim 10 wherein said tablet comprises from about 88 to about 98% be weight of a mixture of anhydrous sodium metasilicate, sodium metasilicate nonahydrate and anhydrous penta-sodium triphosphate; from about 0.5 to about 5.0% by weight of an active chlorine compound; and from about 0.5 to about 7.0% by weight of tabletting aids; all weights being based on the weight of said tablet.

* * * * *